US005437136A

United States Patent [19]

Triebel

[11] Patent Number: 5,437,136

[45] Date of Patent: Aug. 1, 1995

[54] LATTICE GIRDERS, IN PARTICULAR FOR TRUSSES

[75] Inventor: Thomas Triebel, Darmstadt, Germany

[73] Assignee: MERO-Raumstruktur GmbH & Co, Wurzburg, Germany

[21] Appl. No.: 83,762

[22] Filed: Jun. 30, 1993

[30] Foreign Application Priority Data

Jun. 30, 1992 [DE] Germany ..... 42 21 387.8

[51] Int. Cl.[6] ..... E04C 3/02

[52] U.S. Cl. ..... 52/693; 52/667; 52/668

[58] Field of Search ..... 52/693, 695, 690, 668, 52/667, 664, 650.1, 650.2, 651.06, 648.1, 655.1; 403/263, 252, 230, 247, 294, 295, 387

[56] References Cited

U.S. PATENT DOCUMENTS

| | | | |
|---|---|---|---|
| 951,348 | 3/1910 | Stragiotti | 52/693 |
| 1,376,150 | 4/1921 | Miller | 403/230 |
| 2,654,579 | 10/1953 | Cremens | 52/690 X |
| 3,612,585 | 10/1971 | Mayr | 403/230 X |
| 3,672,710 | 6/1972 | Kroop | 403/252 |
| 3,748,778 | 7/1973 | Ellies et al. | 52/667 X |
| 4,485,597 | 12/1984 | Worrallo | 52/690 X |
| 4,918,899 | 4/1990 | Karytinos | 52/690 |

FOREIGN PATENT DOCUMENTS

| | | |
|---|---|---|
| 328695 | 6/1975 | Austria . |
| 1752863 | 7/1968 | Germany . |

OTHER PUBLICATIONS

Meroform Catalog Construction System M12 (1990) (pp. 26, 27).

*Primary Examiner*—Carl D. Friedman
*Assistant Examiner*—Robert J. Canfield
*Attorney, Agent, or Firm*—Lowe, Price, LeBlanc & Becker

[57] ABSTRACT

Known lattice girders consist of two structural chord members joined to each other by a so-called lattice snake welded at its points of inversion to said structural chord members. To circumvent this welding, structural chord members 11 are used which comprise mutually opposite longitudinal slots 18 and thereunder a longitudinal chamber 19. The lattice-snake of the prior art is replaced by individual struts 13 evincing an I section and matching the structural chord members 11. The longitudinal ends of the struts 13 are cut at acute angles and parallel to each other. The two flanges 16 of the struts 13 comprise slots 21 at both ends and parallel to the longitudinal ends of the struts 13. Thereby the struts 13 can be snugly inserted into the longitudinal slots 18 and the chamber 19 of the structural chord members 11 wherein they butt each other.

5 Claims, 4 Drawing Sheets

LATTICE GIRDERS, IN PARTICULAR FOR TRUSSES

DESCRIPTION

Figure 1:
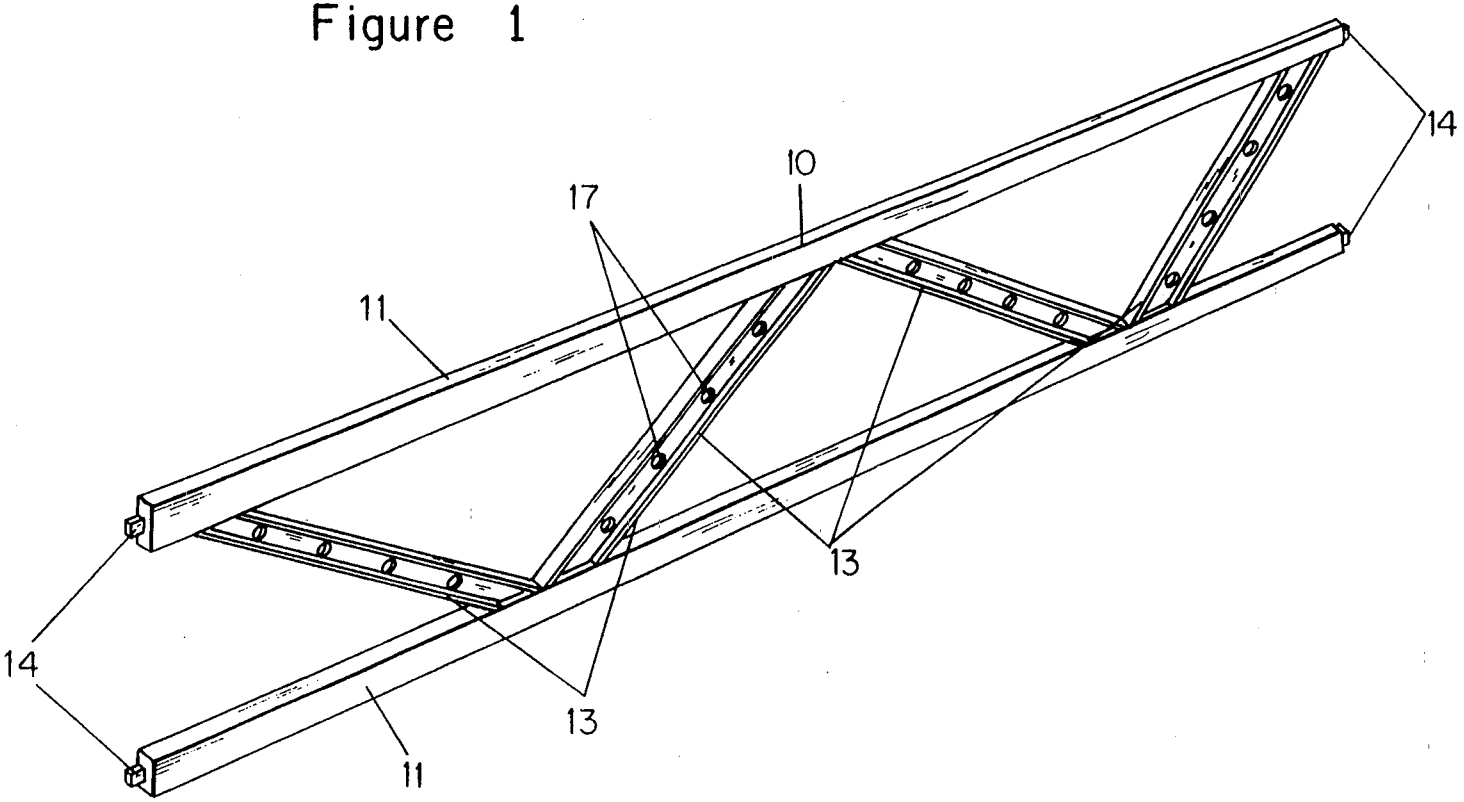

The invention concerns a lattice girder, in particular for trusses, with two structural chord members joined to each other by zig-zagging struts.

In one such known truss (catalogue MEROFORM Bauteile Katalog Bausystem M 12-D 433 MF 2.90), the two structural chord member members are joined to each other by a so-called lattice snake consisting of a round bar bent into zig-zag form. At its inversion points, the lattice is welded to the two structural chord members. This affixing method entails the drawback that the individual parts of the lattice girder cannot surface-treated prior to their connection, namely only the lattice girder as a whole can be, and this amounts to an uneconomic feature. Otherwise welding would damage the surface coating.

The object of the invention is to eliminate the above shortcomings and to create a lattice girder of which the individual parts can be economically connected to one another while avoiding welding.

The invention solves this problem in that (a) the structural chord members comprise mutually opposite longitudinal slots and thereunder longitudinal chambers and the struts evince an I-section matching the structural chord members, (b) depending on their slopes relative to the structural chord members, the longitudinal ends of the struts subtend an angle other than right, and (c) the two strut flanges are slotted in both end zones on both sides parallel to the longitudinal ends of the struts and at such a distance from the longitudinal ends that the struts can be snugly inserted into the longitudinal slots and chambers of the structural chord members, the struts stopping each other inside the shaped struts. Accordingly while avoiding welding, the invention achieves simple affixing of the struts to the structural chord members.

The slope of the struts relative to the structural chord members and hence the height of the entire lattice girder can be easily varied by varying the angle subtended between the strut longitudinal ends and their main axes. Illustratively the structural chord members may be boxy or hollow-circular in cross-section. The labor in cutting the longitudinal ends and in slotting the flanges at the struts is relatively minor, and this is also the case for assembling the struts to the two structural chord members.

The sub-claims state embodiment modes of the invention. Illustratively the strength of connection between the struts and the structural chord members is further improved by the strut web bearing the two flanges being of a thickness practically matching the width of the longitudinal slots in the structural chord members or, in another embodiment mode, by the width of the flanges corresponding to the width of the chamber in the structural chord members.

In yet another embodiment mode of the invention, the strut web preferably comprises holes or is perforated whereby advantageous savings in weight will be achieved in the lattice girders.

Yet another embodiment mode is shown in claim 4.

The invention is elucidated below in relation to the drawings of an embodiment mode.

Figure 2:
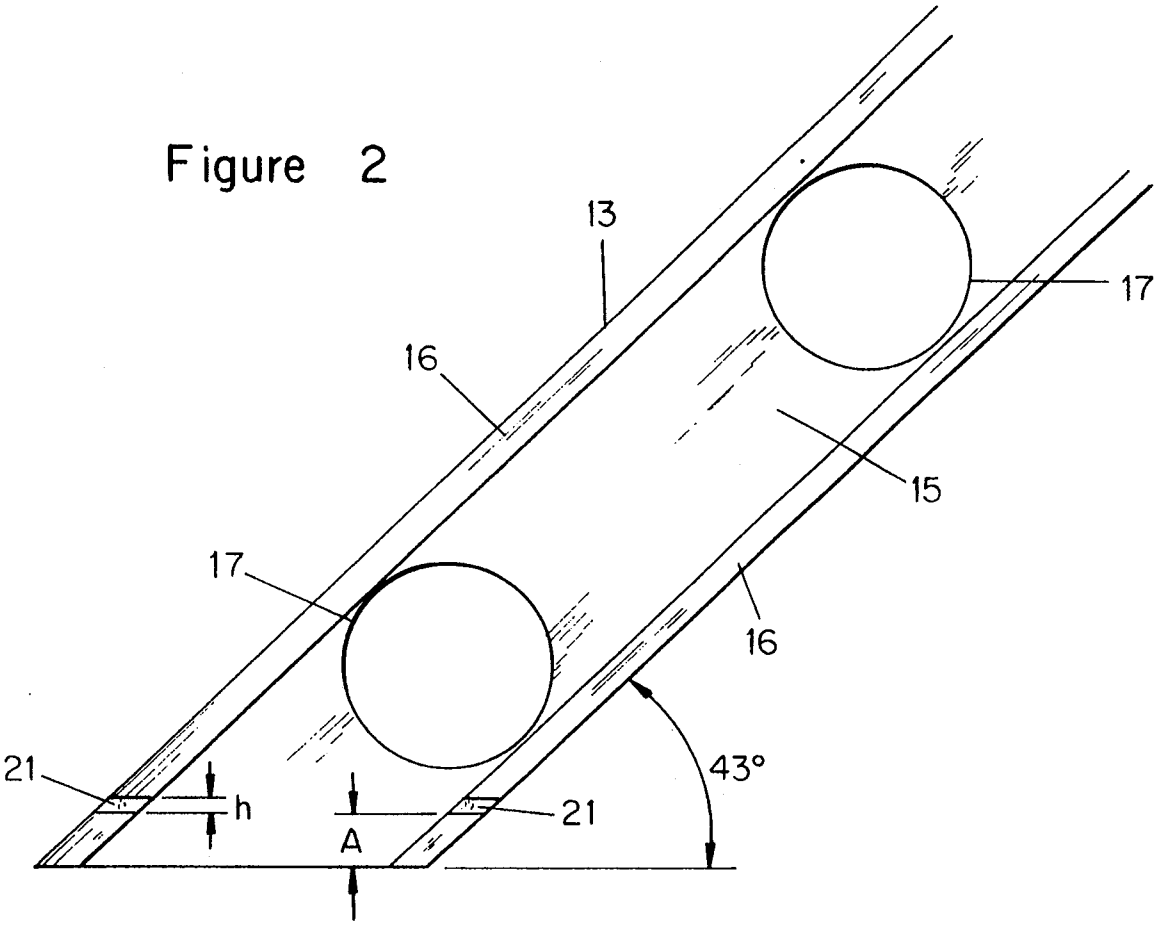
Figure 3:
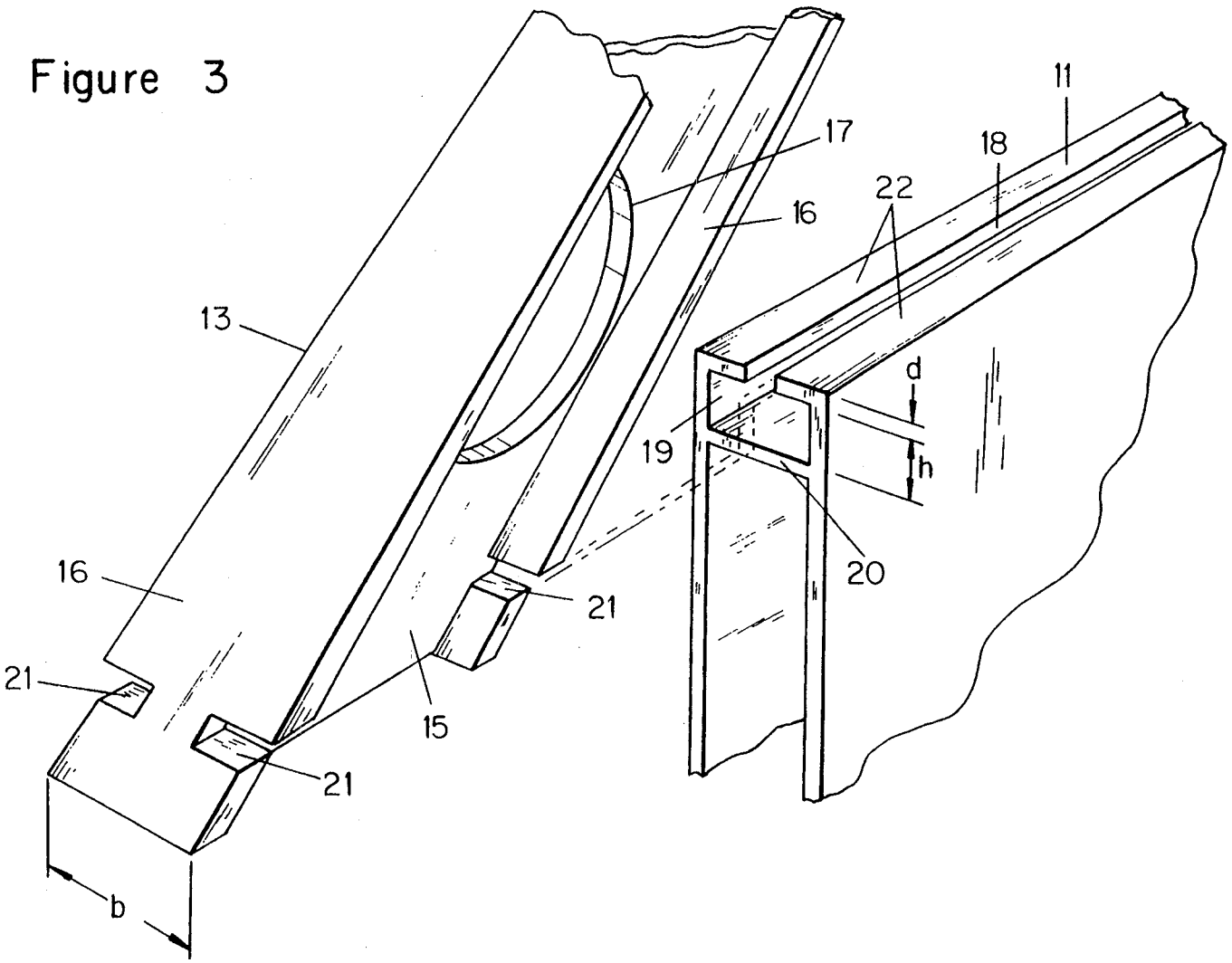
Figure 4:
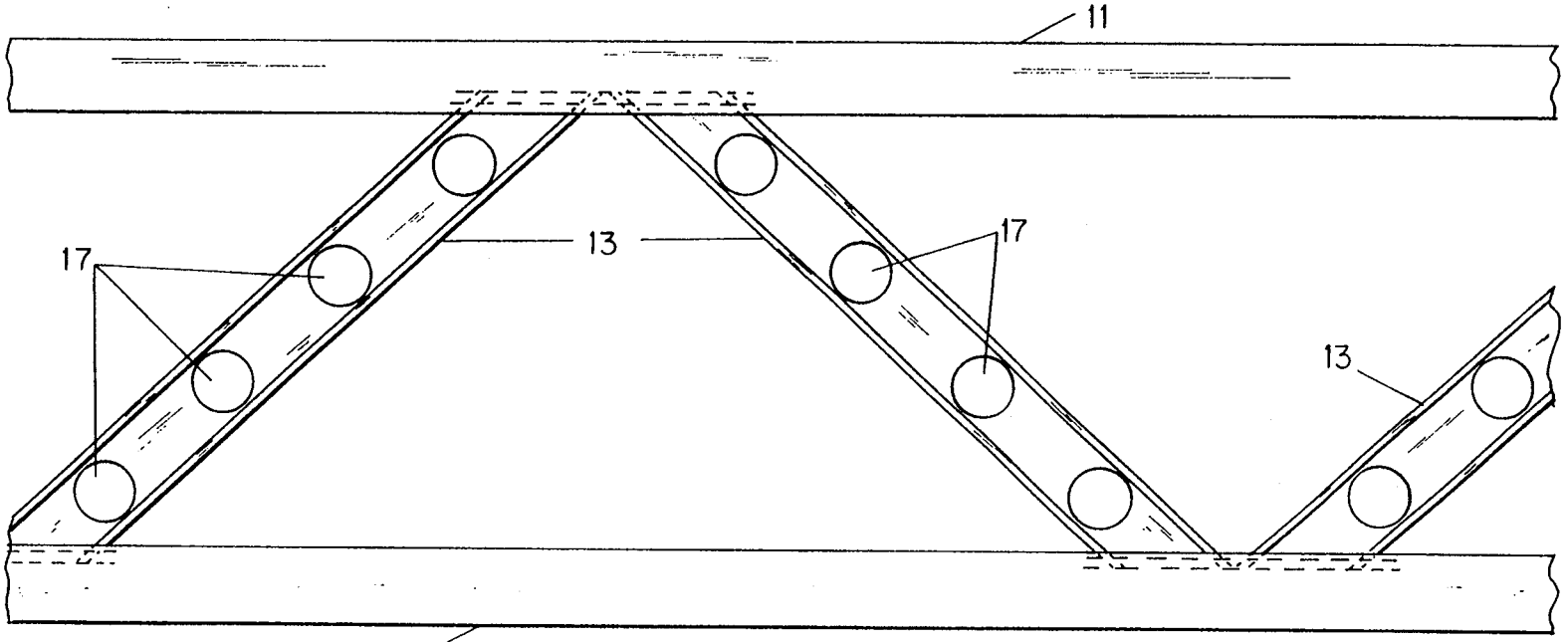
Figure 5:
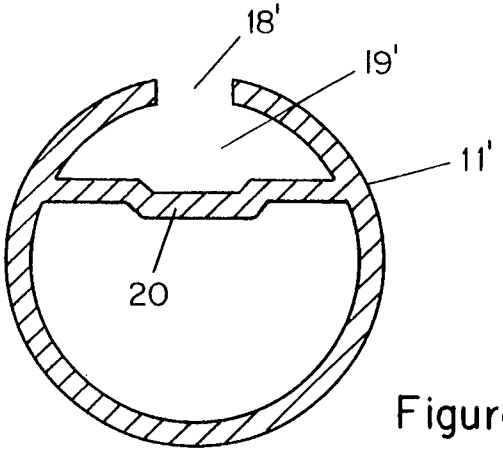

FIG. 1 is a perspective of a lattice girder with two structural chord members connected in the manner of the invention by means of struts, FIG. 2 is a sideview of an end segment of one of the struts of the lattice girder of FIG. 1, FIG. 3 is a perspective of an end segment of a structural chord member and of a strut prior to inserting them into this structural chord member, FIG. 4 is an enlarged cutaway of the lattice girder of FIG. 1, and FIG. 5 is a cross-section of a round, hollow structural chord member which is also suitable for the manufacture of a lattice girder of the invention.

The lattice girder 10 shown in FIG. 1 comprises two structural chord members 11 joined to each other by identical struts 13. A screw or clamping connector 14 is present at each end of each structural chord member 11. This connector 14 can be linked to omitted joint adapters or shaped elements whereby a series of such lattice girders 10 may be assembled for use for instance in exhibition-hall construction.

As already mentioned, the struts 13 are identical and each comprises an I-section, whereby they evince a web 15 and two flanges 16. These strust illustratively and preferably are surface-treated extrusions.

The structural chord members also preferably consist of aluminum extrusions and also are surface-treated. Moreover the structural chord members 11 comprise illustratively a boxy hollow cross-section and further a longitudinal and central slot 18. Each structural chord member 11 comprises a longitudinal chamber 19 underneath the longitudinal slot 18, said chamber being bounded inward for instance by a cross-wall 20. The I-section of the struts 13 matches the structural chord members 11 and this is significant when connecting the struts 13 to the structural chord members 11.

As shown especially clearly by FIGS. 2, 3 and 4, the longitudinal ends of the struts 13 are cut at acute angles, for instance an angle of 43° relative to the main axis of the struts 13 in FIG. 2. Thereby the slope of the struts 13 relative to the structural chord members 11 and the height of the lattice girder 10 shall be predetermined. The two flanges 16 of the struts 13 each comprise a slot 21 parallel to the longitudinal ends of the struts 13 and a constant distance from said end (FIG. 2). The slots 21 extend as far as the web or to such depth at which the remaining central part "c" is slightly narrower than the width of the longitudinal slot 18. The height h of the slots 21 is only slightly larger than the thickness d of the flanges 22 of the structural chord members 11 between which runs the longitudinal slot 18. The width of the longitudinal slot 18 practically corresponds to the thickness of the web 15 of the size of the central part c. The distance A between the particular outer edge of the slots 21 and the particular longitudinal end of the struts 13 illustratively may correspond to the inside height H of the chamber 19. Because of the above design steps and these dimensions, the struts 13 can be snugly inserted by both ends into the longitudinal slots 18 and chambers 19 of the two structural chord members 11, the flanges 22 entering the slots 21 and the longitudinal ends of the struts 13 then resting on the crosswall 20. The width b of flange 16 is only slightly less than the inside width of the chamber 19.

In order to form the zig-zag shape of FIG. 1, the struts 13 are sequentially inserted with alternating sides into the structural chord members 11, and, as shown by FIG. 4, they come to rest by butting against each other at their longitudinal ends while the particular outermost struts 13 of the lattice girder 10 are affixed by omitted clamping screws or similar fasteners to the structural chord members 13.

The structural chord members 11 with their boxy, hollow cross-section can be replaced by members with different hollow cross-sections, illustratively with members 11' evincing a round, hollow section (FIG. 5). These latter also comprise a longitudinal slot 18' and thereunder a chamber 19' which illustratively is bounded inside by a cross-wall 20 running longitudinally in the member 11'. The slots 21 in the struts 13 in this case must be made correspondingly arcuate or tangential so that the ends of the struts 13 can be snugly inserted into the longitudinal slots 18' and chambers 19' of the structural chord members 11'. Illustratively the structural chord members 11' may also be extrusions of aluminum and also are surface treated.

By changing the slope of the longitudinal ends of the struts 13 relative to their main axis, the height taken up by the lattice girder 10 can be changed in simple manner, as already mentioned.

I claim:

1. A lattice girder comprising:

(a) a pair of structural chord members, each chord member having a longitudinal slot in a face thereof which opens into a longitudinal chamber; and (b) a plurality of struts arranged in a zig-zagging relationship to join said pair of structural chord members together, each strut further comprising an I-shaped section having a web and opposing flanges, each flange having slots at both ends of said strut, the slots parallel to end faces of the strut and located along said strut from a respective said end face so that end portions of the struts can be snugly inserted into said longitudinal slots and chambers of the pair of structural chord members;

(c) wherein the end faces of each strut are acutely angled with respect to a strut longitudinal axis to form a predetermined slope with said chord member pair and to permit sequential insertion of the plurality of struts to form said zig-zagging relationship with each strut end portion abutting an adjacent strut end portion.

2. The lattice girder of claim 1 wherein each web has a thickness which corresponds substantially to a width of the longitudinal slot in said structural chord members.

3. The lattice girder of claim 1 wherein each flange has a width corresponding substantially to a width of the longitudinal chamber of the structural chord members.

4. The lattice girder of claim 1 wherein at least one web is perforated.

5. The lattice girder of claim 1 wherein each structural chord member has a second chamber, the second chamber separated from said longitudinal chamber by a cross wall.

* * * * *